US009665111B2

(12) United States Patent
Forejtek

(10) Patent No.: US 9,665,111 B2
(45) Date of Patent: May 30, 2017

(54) LOW DROPOUT VOLTAGE REGULATOR AND METHOD

(71) Applicant: Semiconductor Components Industries, LLC, Phoenix, AZ (US)

(72) Inventor: Jiri Forejtek, Tyniste nad Orlici (CZ)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 139 days.

(21) Appl. No.: 14/594,451

(22) Filed: Jan. 12, 2015

(65) Prior Publication Data

US 2015/0212530 A1 Jul. 30, 2015

(51) Int. Cl.
*G05F 1/56* (2006.01)
*G05F 1/575* (2006.01)

(52) U.S. Cl.
CPC ..... *G05F 1/56* (2013.01); *G05F 1/575* (2013.01)

(58) Field of Classification Search
CPC ..... G05F 1/56; G05F 1/575
See application file for complete search history.

(56) References Cited

U.S. PATENT DOCUMENTS 6,373,295 B2 4/2002 Kadanka et al.
6,518,737 B1 2/2003 Stanescu et al.
7,589,507 B2 * 9/2009 Mandal ..... G05F 1/575 323/270
2003/0111986 A1 6/2003 Xi
2006/0033481 A1 * 2/2006 Thiele ..... G05F 3/262 323/266
2007/0057660 A1 * 3/2007 Lin ..... G05F 1/575 323/316
2007/0216383 A1 * 9/2007 Al-Shyoukh ..... G05F 1/468 323/280
2009/0001953 A1 1/2009 Huang
2009/0128104 A1 5/2009 Mandal
2011/0001458 A1 * 1/2011 Bansal ..... G05F 1/575 323/282
2011/0018515 A1 * 1/2011 McCloy-Stevens H02M 3/1588 323/284
2013/0033244 A1 2/2013 Ock
2013/0113447 A1 5/2013 Kadanka
2013/0241649 A1 9/2013 Fort et al.

OTHER PUBLICATIONS

Understanding Low Drop Out (LDO) Regulators, Michael Day, Texas Instruments, pp. 9-1 to 9-6, Publisher unknown, date unknown.
References and Low Dropout Linear Regulators, Walt Jung, Section 2, pp. 2.1-2.57, Publisher unknown, date unknown.

* cited by examiner

*Primary Examiner* — Jue Zhang
(74) *Attorney, Agent, or Firm* — Rennie William Dover

(57) ABSTRACT

In accordance with an embodiment, a low dropout voltage regulator includes an error amplifier connected to an output driver. The error amplifier has an output connected to an input of the output driver and an input connected to an input of the output driver. The output driver has an input coupled for receiving an input signal. In accordance with another embodiment, a method for regulating a voltage is provided that includes operating a voltage regulator under control of an output voltage regulation loop in response to the voltage regulator not being in a low dropout region. The voltage regulator is operated under control of a quiescent current regulation loop in response to the voltage regulator being in a low dropout region.

20 Claims, 5 Drawing Sheets

200

LOW DROPOUT VOLTAGE REGULATOR AND METHOD

BACKGROUND

The present invention relates, in general, to electronics and, more particularly, to low dropout voltage regulators.

There are various known types of voltage regulators for power management systems, including both linear regulators and switch mode regulators. One particularly useful type of regulator is referred to as a low dropout (LDO) voltage regulator. LDO voltage regulators can operate correctly even when the input voltage is only about 0.5 volts higher than the regulated output voltage, and thus the LDO voltage regulators are particularly useful for high efficiency power management systems like battery operated devices. A typical LDO voltage regulator includes a voltage reference such as a bandgap voltage reference circuit, an error amplifier, and an output voltage divider. The error amplifier changes the output voltage to make the divided output voltage equal to the reference voltage, and typically includes a pass transistor between the input and output voltage terminals.

Because LDO voltage regulators are useful in such a large number of portable applications, semiconductor manufacturers have sought ways to reduce their sizes while maintaining their ability to control large output circuit elements such as a pass transistor. Techniques for reducing the sizes of LDO voltage regulators have resulted in a large increase in their quiescent currents, which reduces their suitability for portable applications because of an increased power drain.

Accordingly, it would be advantageous to have an LDO voltage regulator and method for regulating an output voltage in which the LDO voltage regulator is configured to have a small form factor with a reduced quiescent current. It would be of further advantage for the LDO voltage regulator and method to be cost efficient to implement.

BRIEF DESCRIPTION OF THE DRAWINGS

The present invention will be better understood from a reading of the following detailed description, taken in conjunction with the accompanying drawing figures, in which like reference characters designate like elements and in which.

Figure 1:
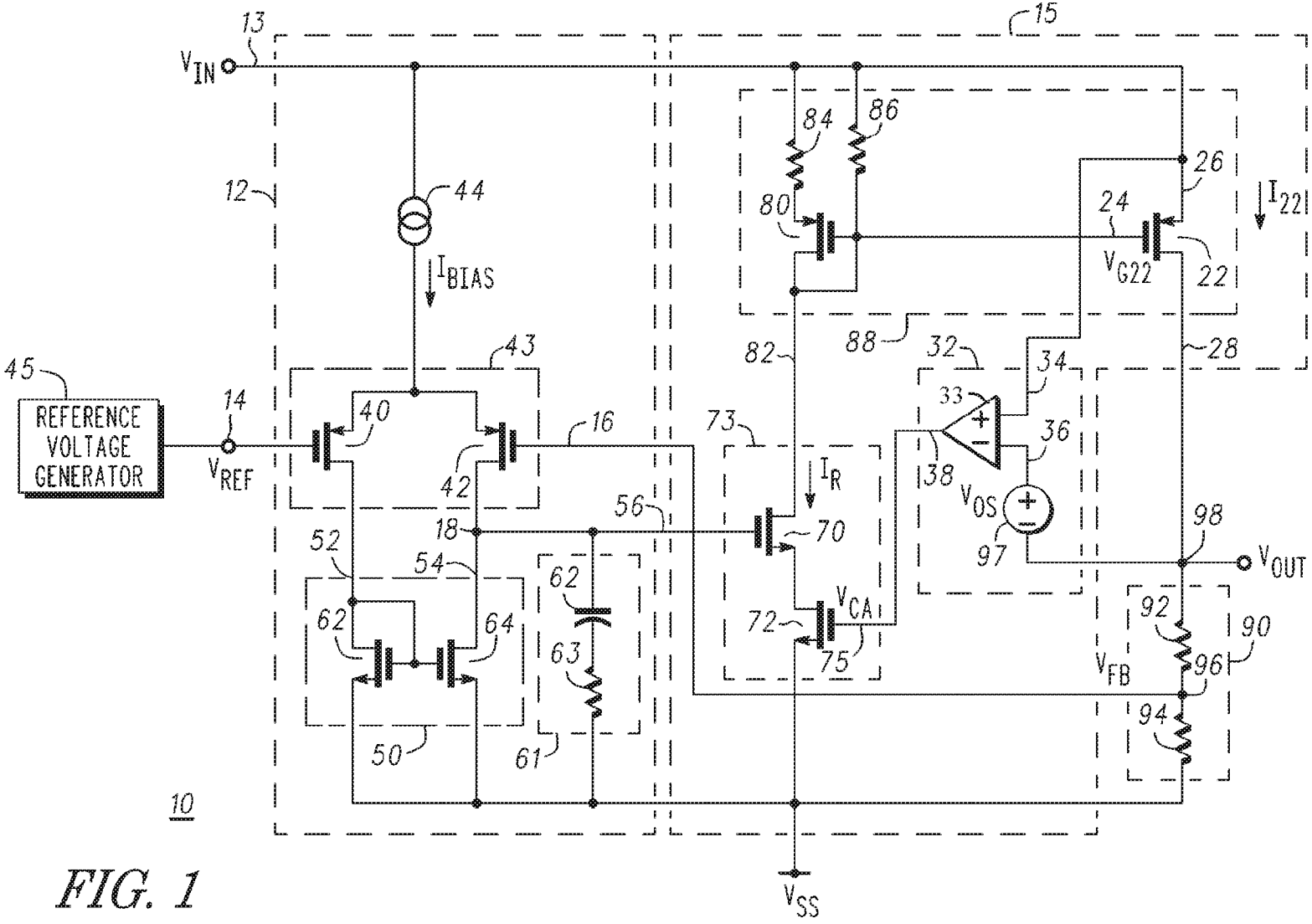
FIG. 1 is a circuit schematic of an LDO voltage regulator in accordance with an embodiment of the present invention.

For simplicity and clarity of illustration, elements in the figures are not necessarily to scale, and the same reference characters in different figures denote the same elements. Additionally, descriptions and details of well-known steps and elements are omitted for simplicity of the description. As used herein current carrying electrode means an element of a device that carries current through the device such as a source or a drain of an MOS transistor or an emitter or a collector of a bipolar transistor or a cathode or anode of a diode, and a control electrode means an element of the device that controls current flow through the device such as a gate of an MOS transistor or a base of a bipolar transistor. Although the devices are explained herein as certain N-channel or P-channel devices, or certain N-type or P-type doped regions, a person of ordinary skill in the art will appreciate that complementary devices are also possible in accordance with embodiments of the present invention. It will be appreciated by those skilled in the art that the words during, while, and when as used herein are not exact terms that mean an action takes place instantly upon an initiating action but that there may be some small but reasonable delay, such as a propagation delay, between the reaction that is initiated by the initial action. The use of the word approximately, about, or substantially means that a value of an element has a parameter that is expected to be very close to a stated value or position. However, as is well known in the art there are always minor variances that prevent the values or positions from being exactly as stated. It is well established in the art that variances of up to about ten percent (10%) (and up to twenty percent (20%) for semiconductor doping concentrations) are regarded as reasonable variances from the ideal goal of exactly as described.

It should be noted that a logic zero voltage level ($V_L$) is also referred to as a logic low voltage and that the voltage level of a logic zero voltage is a function of the power supply voltage and the type of logic family. For example, in a Complementary Metal Oxide Semiconductor (CMOS) logic family a logic zero voltage may be thirty percent of the power supply voltage level. In a five volt Translator-Translator Logic (TTL) system a logic low voltage level may be about 0.8 volts, whereas for a five volt CMOS system, the logic zero voltage level may be about 1.5 volts. A logic one voltage level ($V_H$) is also referred to as a logic high voltage level and, like the logic zero voltage level, the logic high voltage level also may be a function of the power supply and the type of logic family. For example, in a CMOS system a logic one voltage may be about seventy percent of the power supply voltage level. In a five volt TTL system a logic one voltage may be about 2.4 volts, whereas for a five volt CMOS system, the logic one voltage may be about 3.5 volts.

DETAILED DESCRIPTION

Generally, the present invention provides a low dropout voltage regulator and a method for regulating a voltage, wherein the low dropout voltage regulator includes an error amplifier coupled to an output driver, wherein the output driver includes a pass transistor, a quiescent current regulation amplifier, and a current control circuit. The pass transistor forms part of a current mirror and has a drain electrode connected to an inverting input terminal of the quiescent current regulation amplifier and a source electrode connected to a noninverting input terminal of the quiescent current regulation amplifier. In addition, an offset voltage is associated with the quiescent current regulation amplifier. An output terminal of the quiescent current regulation amplifier is connected to the input of the current control circuit.

In accordance with another embodiment, a method for regulating a voltage is provided that comprises operating a voltage regulator under control of an output voltage regulation loop in response to the voltage regulator configured not to be in a low dropout region. The voltage regulator is operated under the control of a quiescent current regulation loop in response to the voltage regulator configured to be in a low dropout region.

In accordance with another embodiment, a method for regulating a voltage is provided wherein in response to operating in a first mode a feedback voltage is compared with a reference voltage to generate comparison signal. A first current is generated in response to the comparison signal and a mirrored current is generated by mirroring the first current, wherein the mirrored current flows towards an output of a voltage regulator. In response to operating in a second mode, a first voltage is generated at the output in response to the mirrored current. A quiescent current amplifier generates a current adjust voltage in response to an input voltage and the first voltage appearing at first and second input terminals of the quiescent current amplifier. The first current is generated in response to the current adjust voltage and the first current is mirrored to form a mirrored current that serves as a drain to source current of a transistor coupled to the output of the voltage regulator.

FIG. 1 is a circuit schematic of a low dropout voltage regulator 10 in accordance with an embodiment of the present invention. What is shown in FIG. 1 is an error amplifier 12 coupled to an output driver 15 and a voltage divider network 90 coupled to output driver 15. Error amplifier 12 has an input terminal 14 coupled for receiving a reference voltage, $V_{REF}$, from a reference voltage generator 45, an input terminal 16 coupled for receiving a feedback voltage, $V_{FB}$, and an output terminal 18. By way of example, error amplifier 12 includes transistors 40 and 42 configured as a differential pair 43, which differential pair 43 is connected to a current source 44. Transistor 40 has a gate electrode connected to or, alternatively, serving as input terminal 14, transistor 42 has a gate electrode connected to or, alternatively, serving as input terminal 16, and transistors 40 and 42 have source electrodes commonly connected together and to a terminal for receiving a bias current $I_{BIAS}$ from current source 44. Current source 44 is connected between the source electrodes of transistors 40 and 42 and an input terminal 13. The drain electrode of transistor 40 is connected to a terminal 52 of a current mirror 50 and the drain electrode of transistor 42 is connected to a terminal 54 of current mirror 50. Current mirror 50 may be comprised of a pair of field effect transistors 62 and 64 having commonly connected gate electrodes and commonly connected source electrodes, where the gate electrode of transistor 62 is connected to its drain electrode to form terminal 52 of current mirror 50 and the drain electrode of transistor 64 serves as terminal 54 of current mirror 50. The source electrodes of transistors 62 and 64 are coupled for receiving a source of operating potential $V_{SS}$. By way of example, operating potential $V_{SS}$ is a ground potential. The drain electrodes of transistors 42 and 64 are commonly connected together to form output terminal or output node 18. As discussed above, the gate electrodes of transistors 40, 42, 62, and 64 may be referred to as control electrodes and the drain and source electrodes of transistors 40, 42, 62, and 64 may be referred to as current carrying electrodes.

Error amplifier 12 further includes a frequency compensation network 61 coupled between output terminal 18 and source of operating potential $V_{SS}$. Frequency compensation network 61 may be comprised of a capacitor 62 and a resistor 63 that are connected in series. It should be noted that the circuit configuration or topology of error amplifier 12 is not a limitation of the present invention.

Reference voltage generator 45 may be, for example, a bandgap reference voltage generator. However, the topology of reference voltage generator 45 is not a limitation of the present invention.

Output driver 15 may be comprised of a current control circuit 73, a current mirror 88, and a quiescent current regulation amplifier 32. In accordance with an embodiment, current mirror 88 includes transistors 22 and 80, where transistor 80 has a source electrode connected to input terminal 13 through a resistor 84 for receiving input voltage $V_{IN}$ and a gate electrode commonly connected to the drain electrode of transistor 80 and to the gate electrode of transistor 22. The commonly connected gate electrode and drain electrode form a terminal 82 of current mirror 88, wherein terminal 82 is connected to a terminal of current control circuit 73. In addition, the commonly connected gate electrodes of transistors 22 and 80 may be coupled for receiving input voltage $V_{IN}$ through a resistor 86. Transistor 22 may be referred to as a pass transistor and it may be a power transistor or a power MOSFET (Metal Oxide Semiconductor Field Effect Transistor). It should be noted that resistors 84 and 86 are optional circuit elements and may be absent or replaced by other circuit elements suitable for stabilizing current mirror 88. For example, resistor 84 may be absent and resistor 86 may be absent or resistor 86 may be replaced by a current source or a network comprising a diode connected MOS (Metal Oxide Semiconductor) transistor connected in series with a resistor. Transistors 22 and 80 and resistors 84 and 86 are configured to form current mirror 88 wherein transistors 22 and 80 are sized such that the ratio of the Width to Length, i.e., (W/L) ratio, of transistor 80 to the (W/L) ratio of transistor 22 is the ratio 1:N, where N is an integer.

The source electrode of transistor 22 is connected to input terminal 13 for receiving input voltage $V_{IN}$ and to a noninverting input terminal 34 of quiescent current regulation amplifier 32 and the drain electrode of transistor 22 is coupled to inverting input 36 of quiescent current regulation amplifier 32. It should be noted that quiescent regulation amplifier 32 is shown as an amplifier 33 having a noninverting input 34 and an inverting input 36, wherein inverting input 36 is connected to a voltage source 97 that represents an offset voltage $V_{OS}$ of amplifier 32. As those skilled in the art will appreciate, amplifiers typically include an offset voltage, which may or may not be shown in a circuit structure. For the sake of completeness the offset voltage $V_{OS}$ is shown in FIG. 1. The output terminal of quiescent voltage regulation amplifier 32 is connected to an input terminal 75 of current control circuit 73. By way of example, current control circuit 73 is comprised of transistors 70 and 72, where transistor 70 has a gate electrode connected to output terminal 18 at a input 56, a drain electrode connected to terminal 82 of current mirror 88 and a source electrode connected to a drain electrode of transistor 72. Input 56 may be referred to as a node, input terminal, or input node. Transistor 72 has a gate electrode which serves as input terminal 75, and which is coupled for receiving a current adjust voltage $V_{CA}$ and a source electrode coupled for receiving source of operating potential $V_{SS}$. As discussed above, the gate electrodes of transistors 22, 80, 70, and 72 may be referred to as control electrodes, the drain and source electrodes of transistors 22, 80, 70, and 72 may be referred to as current carrying electrodes, and operating potential $V_{SS}$ may be a ground potential.

The drain electrode of transistor 22 is also connected to voltage divider network 90, which may be comprised of series connected resistors 92 and 94, wherein a terminal of resistor 92 is connected to the drain electrode of transistor 22 to form a node 98 which serves as an output of low dropout voltage regulator 10 for transmitting output signal $V_{OUT}$, and the other terminal of resistor 92 is connected to a terminal of resistor 94 to form a node 96 which is connected to input terminal 16 of error amplifier 12. The other terminal of resistor 94 is coupled for receiving a source of operating potential such as, for example, operating potential $V_{SS}$. Node 96 may serve as another output of low dropout voltage regulator 10 or as an input/output of low dropout voltage regulator 10.

Although, the noninverting input 34 of quiescent current regulation amplifier 32 is shown as being connected to the source of transistor 22 and the inverting input 36 of quiescent current regulation amplifier 32 is shown as being connected to the drain of transistor 22 through offset voltage $V_{OS}$, this is not a limitation of the present invention. Inputs 34 and 36 may be connected to other circuit elements suitable for generating voltage $V_{CA}$ at input 75.

In accordance with embodiments of the present invention, low dropout voltage regulator 10 includes two regulation loops: an output voltage regulation loop and a quiescent current regulation loop. In response to low dropout voltage regulator 10 operating under control of the output voltage regulation loop, the drain to source voltage ($V_{DS22}$) of pass transistor 22 is greater than or higher than offset voltage $V_{OS}$ and voltage $V_{CA}$ at the gate of transistor 72, i.e., at input 75, is set to or tied to input voltage $V_{IN}$. It should be noted that the on-resistance of transistor 72 is sufficiently small that it does not influence the operation of the output voltage regulation loop. Error amplifier 12 generates a reference current $I_R$ in response to comparing voltage $V_{REF}$ that appears at input terminal 14 with voltage $V_{FB}$ that appears at input terminal 16. Current mirror 88 generates a current $I_{22}$ in response to its mirroring action on current $I_R$. In other words, current $I_R$ is amplified and mirrored to pass transistor 22 as drain to source current $I_{22}$.

When a load is coupled to node 98, a portion of current $I_{22}$ flows through the load and a portion flows through voltage divider network 90. It should be noted that a portion of current $I_{22}$ may be 100% of current $I_{22}$, 0% of current $I_{22}$, or a percentage between 0% and 100%. When there is no load coupled to node 98, all or substantially all of current $I_{22}$ flows through voltage divider network 90. Error amplifier 12 operates to maintain feedback voltage $V_{FB}$ at substantially the same voltage level as voltage $V_{REF}$. Because resistors 92 and 94 are connected in series, the current generated by feedback voltage $V_{FB}$ and resistor 94 also flows through resistor 92. Thus, output voltage $V_{OUT}$ is the sum of voltage $V_{SS}$, the voltage across resistor 94, and the voltage across resistor 92, i.e., the sum of voltage $V_{FB}$ and the voltage across resistor 92. In response to feedback voltage $V_{FB}$ being lower than reference voltage $V_{REF}$, error amplifier 12 decreases a voltage $V_{G22}$ appearing at the gate of pass transistor 22 and increases current $I_R$, which increases a current $I_{22}$ and increases output voltage $V_{OUT}$. In response to feedback voltage $V_{FB}$ being greater than reference voltage $V_{REF}$, error amplifier 12 increases voltage $V_{G22}$ appearing at the gate of pass transistor 22 and decreases current $I_R$, which decreases a current $I_{22}$ and decreases output voltage $V_{OUT}$.

In response to low dropout voltage regulator 10 operating in a dropout regulation operating mode, i.e., the quiescent current regulation loop operating under light load or no load conditions, quiescent current regulation amplifier 32 senses drain to source voltage $V_{DS22}$ of pass transistor 22 and regulates current $I_R$ using transistor 72. When the value of the drain to source voltage $V_{DS22}$ approaches the value of the offset voltage $V_{OS}$ during light load or no load conditions, current regulation amplifier 32 regulates current $I_R$ so that the drain to source voltage $V_{DS22}$ of pass transistor 22 becomes equal to offset voltage $V_{OS}$, thereby reducing the quiescent current of low dropout voltage regulator 10 when a light load or no load is coupled to node 98. Typically a light load is one in which an output current has a value up to about 10% to 15% of the maximum load current for small currents, i.e., currents around 10 milliamps.

Figure 2:
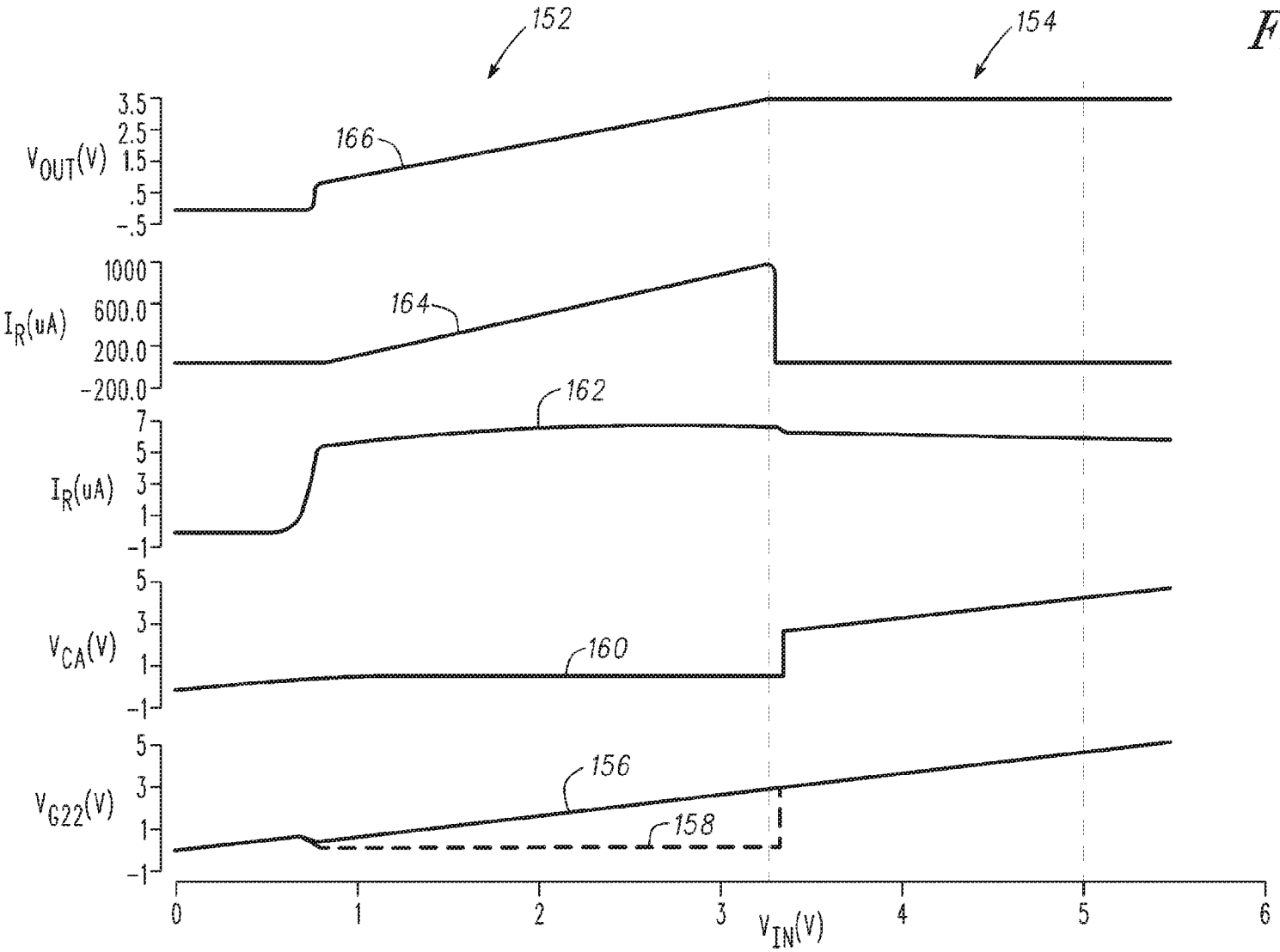
FIG. 2 is a graph of various currents and voltages versus an input voltage of the LDO voltage regulator of FIG. 1 in accordance with an embodiment of the present invention.

FIG. 2 is a simulation graph 150 that includes plots of voltage and current versus input voltage under no load conditions in accordance with embodiments of the present invention. Simulation graph 150 illustrates operation of low dropout voltage regulator 10 in the dropout regulation region 152, i.e., operation under control of the quiescent current regulation loop, and in the output voltage regulation region 154, i.e., under control of the output voltage regulation loop. Dropout regulation region 152 may be referred to as the dropout operating region and output voltage regulation region 154 may be referred to as the voltage regulation region. In this example, the dropout regulation region occurs for an input voltage $V_{IN}$ ranging from about 0.9 volts to a voltage equal to the sum of the nominal output voltage $V_{OUTNOM}$ and the dropout voltage $V_{DROPOUT}$ and the voltage regulation region occurs for an input voltage $V_{IN}$ that is greater than the sum of the nominal output voltage and the dropout voltage. It should be understood that $V_{OUTNOM}$ is the nominal output voltage for which LDO voltage regulator 10 is designed and $V_{OUT}$ is the present output voltage of the LDO voltage regulator in accordance with a given condition, i.e., the input voltage level, the load, etc. In the dropout region $V_{OUT}$ is less than $V_{OUTNOM}$. Plot 156 illustrates the voltage $V_{G22}$ at the gate of pass transistor 22 versus input voltage $V_{IN}$. When LDO regulator circuit 10 operates under control of the quiescent current regulation loop, i.e., in the dropout region, quiescent current regulation amplifier 32, offset voltage $V_{OS}$, and transistor 72 cooperate to raise gate voltage $V_{G22}$ as input voltage $V_{IN}$ increases thereby keeping drain to source voltage $V_{DS22}$ equal to offset voltage $V_{OS}$ and maintaining current $I_R$ at a level that does not cause a large increase the quiescent current.

For the sake of comparison, graph 150 includes a plot 158 illustrating that in a prior art device, gate voltage $V_{G22}$ remains substantially constant as the input voltage $V_{IN}$ increases while operating in the dropout region. Thus, in a prior art device, current $I_R$ significantly increases resulting in a large increase in the gate to source voltage of transistor 80 because terminal 82 is held substantially at ground potential. This results in an undesirable increase in the quiescent current. It should be noted that when LDO regulator circuit 10 operates under control of the output voltage regulation loop, i.e., in the output voltage regulation region, gate voltage $V_{G22}$ is increased as input voltage $V_{IN}$ increases.

Plot 160 is a plot of voltage $V_{CA}$ at input 75 versus input voltage $V_{IN}$ in the dropout regulation region and in the output voltage regulation region. During operation in the dropout regulation region, quiescent current regulation amplifier 32 is configured to maintain voltage $V_{CA}$ at a voltage close to the threshold voltage of transistor 72. Under this condition, transistor 72 operates as a voltage controlled current source which limits current $I_R$ and gate voltage $V_{G22}$ to values that are sufficient to keep low dropout regulator 10 in regulation. Because quiescent current regulation amplifier 32 is configured to place a voltage substantially equal to voltage $V_{IN}$ at input 75 during operation in the output voltage regulation region, trace 160 illustrates that in this operating region, voltage $V_{CA}$ increases with input voltage $V_{IN}$.

Plot 162 is a plot of current $I_R$ (in microamps, μm) versus input voltage $V_{IN}$ in the dropout regulation region and in the output voltage regulation region in accordance with an embodiment of the present invention. During both low dropout regulation and output voltage regulation, current $I_R$ is substantially flat as input voltage $V_{IN}$ is increased.

Plot 164 is included to show that in a prior art device operating in the dropout regulation region, current $I_R$ starts at a higher level than that shown in plot 162 and increases to a very high value, i.e., close to 1 milliamp. In this example, current $I_R$ of a prior art LDO regulator is more than 100 times higher than in an LDO regulator in accordance with embodiments of the present invention. Thus, the quiescent current of a prior art LDO regulator is very large which is undesirable in portable applications.

Plot 166 shows that in the dropout regulation region the output voltage increases as input voltage $V_{IN}$ increases and in the output voltage regulation region the output voltage remains at the nominal output voltage $V_{OUTNOM}$ as input voltage $V_{IN}$ is increased. It should be noted that plot 166 represents the response for LDO voltage regulators in accordance with embodiments of the present invention and prior art LDO voltage regulators. Because the plots are substantially overlapping, they are shown as a single plot. The voltage difference between the two plots is substantially equal to offset voltage $V_{OS}$ in the dropout regulation region.

Figure 3:
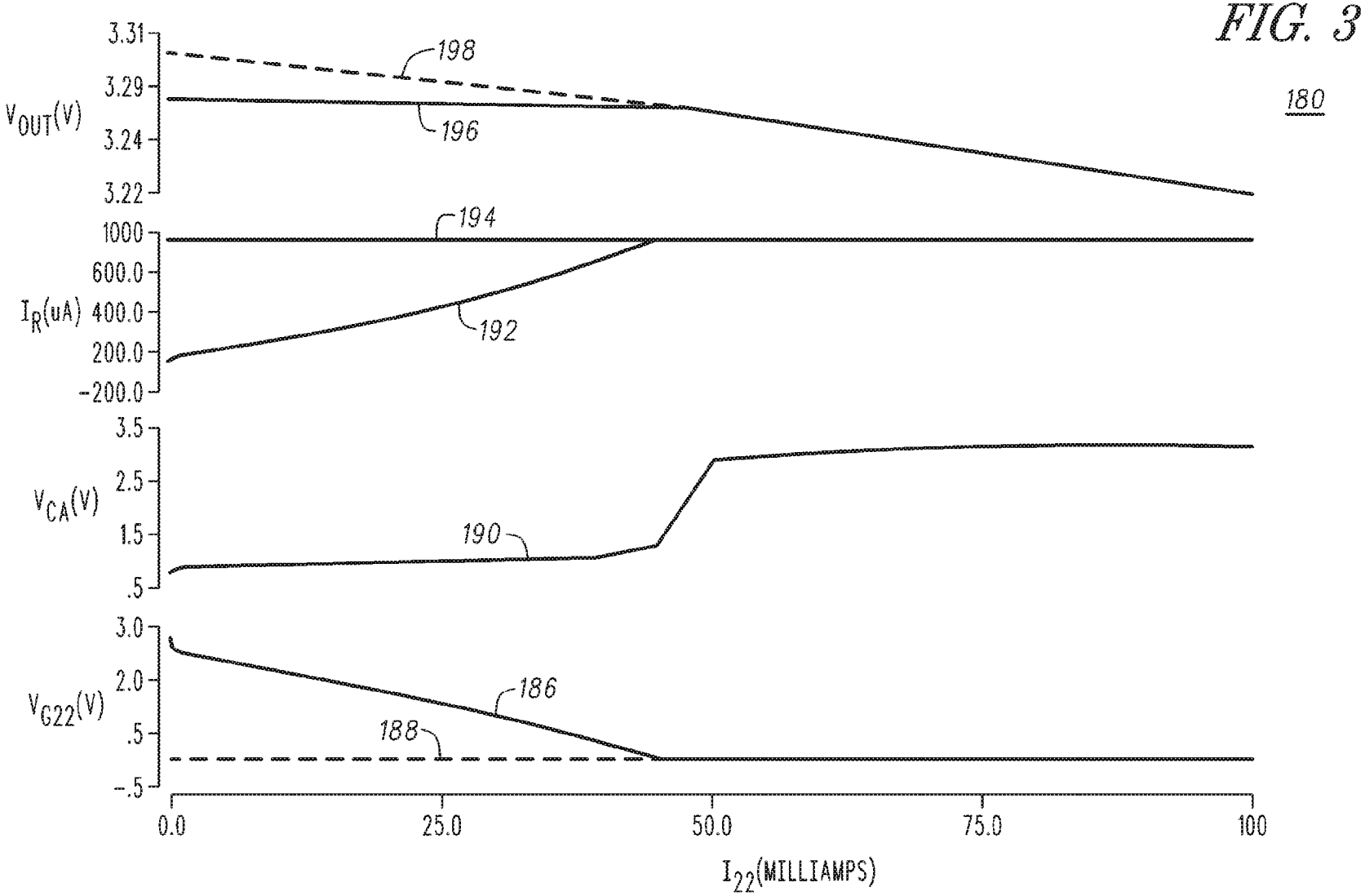
FIG. 3 is a graph of various currents and voltages versus an output current of the LDO voltage regulator of FIG. 1 in accordance with an embodiment of the present invention.

FIG. 3 is a simulation graph 180 that includes plots of voltage and current versus output current in accordance with embodiments of the present invention. FIG. 3 illustrates that the quiescent current regulation loop is active over a range of currents $I_{22}$. For example, drain to source voltage $V_{DS22}$ of pass transistor 22 increases in response to current $I_{22}$ increasing. When drain to source voltage $V_{DS22}$ is higher than offset voltage $V_{OS}$ the quiescent current regulation loop is inactive. Simulation graph 180 illustrates operation of low dropout voltage regulator 10 in the dropout regulation region, wherein input voltage $V_{IN}$ is substantially equal to output voltage $V_{OUTNOM}$. Plot 186 illustrates the voltage $V_{G22}$ at the gate of pass transistor 22 versus current $I_{22}$. In the dropout regulation region, quiescent current regulation amplifier 32, offset voltage $V_{OS}$, transistor 72, and transistor 70 cooperate to lower gate voltage $V_{G22}$ as current $I_{22}$ is increased. For the sake of comparison, simulation graph 180 includes a plot 188 illustrating that in a prior art low dropout voltage regulator, gate voltage $V_{G22}$ remains substantially constant as current $I_{22}$ is increased in the dropout region. FIG. 3 describes the behavior of the quiescent current regulation loop in response to current $I_{22}$ being swept over a range of values.

Plot 190 illustrates voltage $V_{CA}$ at input 75 versus current $I_{22}$ in the dropout regulation region. As discussed with reference to plot 160, during operation in the dropout regulation region, quiescent current regulation amplifier 32 is configured to maintain voltage $V_{CA}$ at a voltage close to the threshold voltage of transistor 72. Under this condition, transistor 72 operates as a voltage controlled current source which limits current $I_R$ and gate voltage $V_{G22}$ to values that are sufficient to keep low dropout regulator 10 in regulation.

Plot 192 illustrates current $I_R$ (in microamps) versus current $I_{22}$ (in milliamps) in the dropout regulation region for an LDO voltage regulator in accordance with embodiments of the present invention. Plot 192 shows that current $I_R$ is proportional to current $I_{22}$ as long as the dropout voltage of pass transistor 22 is lower than the offset voltage $V_{OS}$. Here quiescent current regulation amplifier 32 is actively regulating current $I_R$. The dropout voltage of pass transistor 22 is equal to the product of the resistance Rdson and current $I_{22}$. Plot 194 illustrates current $I_R$ versus current $I_{22}$ in the dropout regulation region for a prior art LDO voltage regulator. Because current $I_R$ for LDO voltage regulators configured in accordance with embodiments of the present invention is less than that for prior art LDO voltage regulators, the quiescent current of LDO voltage regulators is reduced for LDO voltage regulators such as, for example LDO voltage regulator 10 and therefore power consumption is less, which is desirable in portable electronic applications.

Plot 196 shows that in the dropout regulation region the output voltage $V_{OUT}$ remains substantially constant with a value equal to the input voltage minus the offset voltage ($V_{IN}$–$V_{OS}$) for small currents when the quiescent current regulation loop is active for LDO voltage regulators configured in accordance with embodiments of the present invention. When the quiescent current regulation loop stops regulating then the output voltage is the same for LDO voltage regulators configured in accordance with embodiments of the present invention and for prior art LDO voltage regulators. Plot 198 shows that in the dropout regulation region the output voltage $V_{OUT}$ decreases as current $I_{22}$ increases for prior art LDO voltage regulators.

Figure 4:
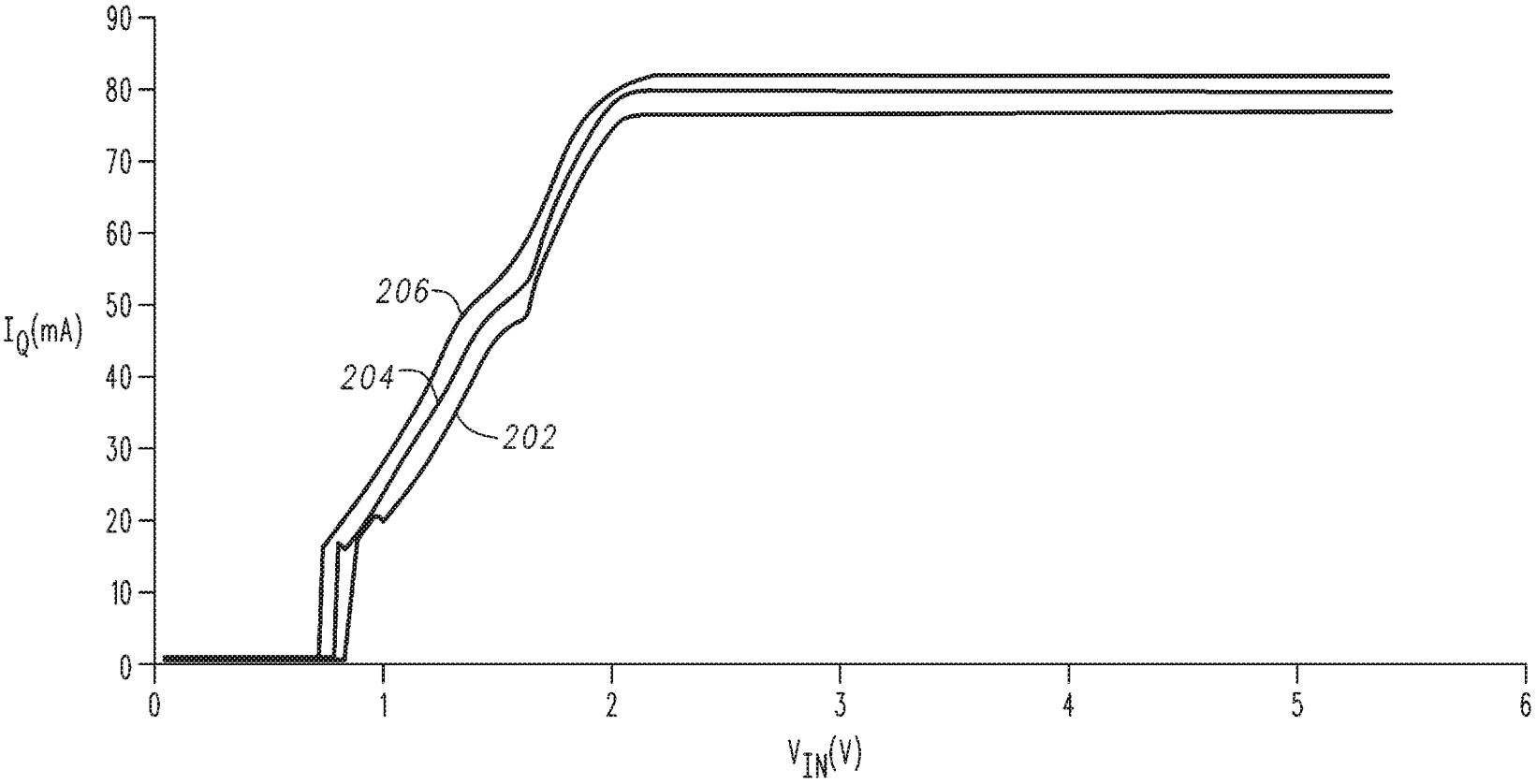
FIG. 4 is a graph of quiescent current versus an input voltage of the LDO voltage regulator of FIG. 1 in accordance with an embodiment of the present invention.

FIG. 4 is a data graph 200 of quiescent current $I_Q$ versus input voltage $V_{IN}$ at three temperatures for a nominal output voltage $V_{OUTNOM}$ of 2.8 volts. Plot 202 illustrates quiescent current $I_Q$ versus input voltage $V_{IN}$ at −40 degrees Celsius (° C.); plot 204 illustrates quiescent current $I_Q$ versus input voltage $V_{IN}$ at 25° C.; and plot 206 illustrates quiescent current $I_Q$ versus input voltage $V_{IN}$ at 125° C. In particular, plots 202-206 illustrate that over temperature, LDO voltage regulators configured in accordance with embodiments of the present invention exhibit a substantially flat quiescent current in response to input voltage $V_{IN}$ for LDO voltage regulator 10 operating in the dropout regulation region and operating in the output voltage regulation region.

Figure 5:
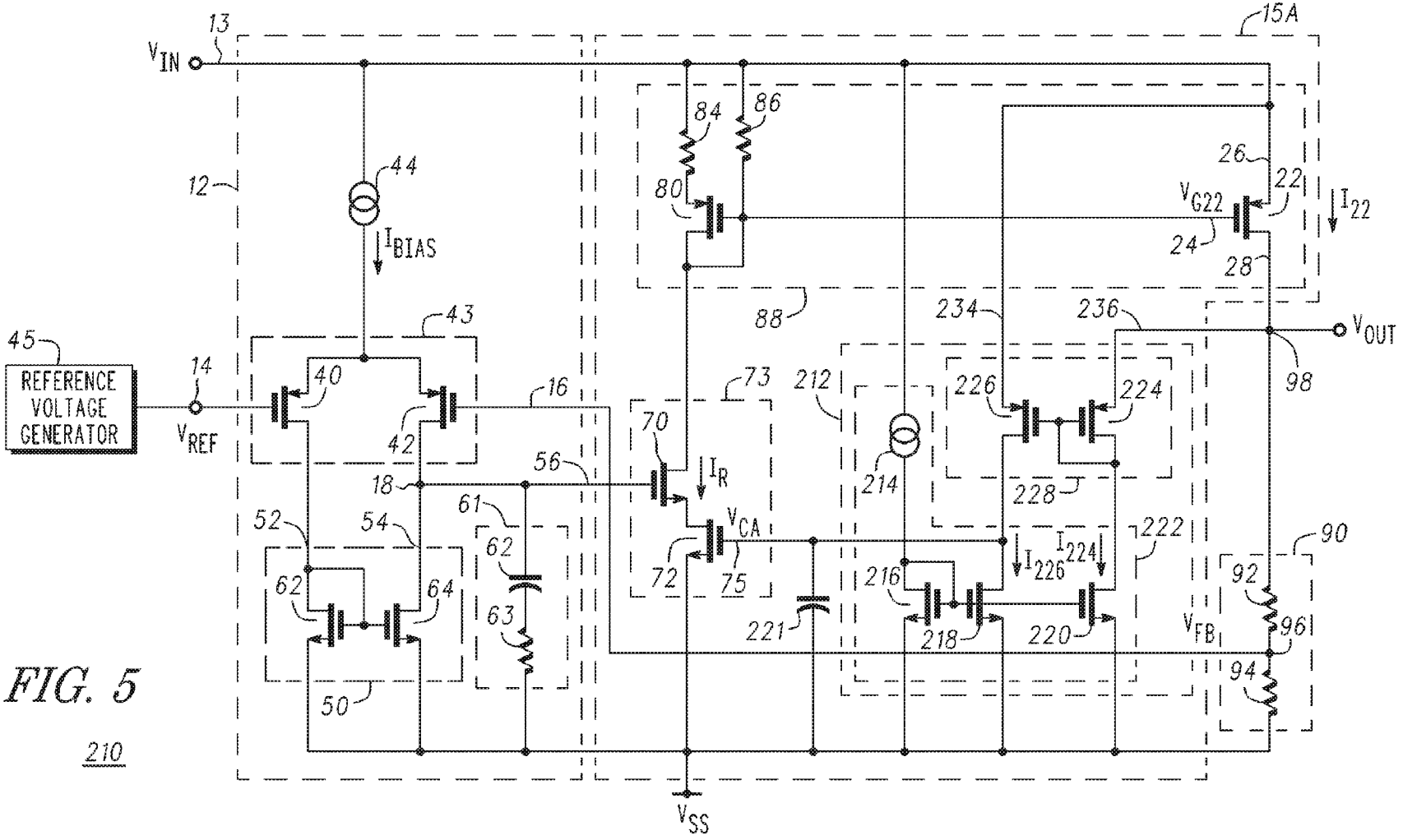
FIG. 5 is a circuit schematic of an LDO voltages regulator in accordance with another embodiment of the present invention.

FIG. 5 is a circuit schematic of a low dropout voltage regulator 210 in accordance with another embodiment of the present invention. What is shown in FIG. 5 is an error amplifier 12 coupled to an output driver 15A and a voltage divider network 90 coupled to output driver 15A. Error amplifier 12 has been described with reference to FIG. 1. In addition, current mirror 88, pass transistor 22, and current control circuit 73 of output driver 15A and voltage divider circuit 90 have been described with reference to FIG. 1. Output driver 15A further includes a quiescent current regulation amplifier 212. Because the topology of quiescent current regulation amplifier 212 may be different than that of quiescent current regulation amplifier 32 of FIG. 1, a reference character "A" has been appended to reference character "15" to distinguish these topologies.

Quiescent current regulation amplifier 212 includes current source 214 and transistors 216, 218, and 220 which are configured as a current mirror 222 and transistors 224 and 226 which are configured as a current mirror 228. Current mirror 228 is configured to generate an input differential signal that includes an offset voltage such as offset voltage $V_{OS}$ described with reference to FIG. 1. Transistors 216, 218, and 220 have gates or gate electrodes that are connected together and to the drain electrode of transistor 216. The gate electrodes of transistors 216, 218, and 220 are connected to the drain electrode of transistor 216 and to a terminal of a current source 214. Current source 214 also has a terminal connected to terminal 13 for receiving input voltage $V_{IN}$. In addition, transistors 216, 218, and 220 have source electrodes that are connected together and coupled for receiving a source of operating potential such as operating potential $V_{SS}$. By way of example, operating potential $V_{SS}$ is ground potential. Transistors 226 and 224 have gate electrodes that are connected together and to the drain electrode of transistor 224. The drain electrode of transistor 224 is connected to the drain electrode of transistor 220 and the drain electrode of transistor 226 is connected to the drain electrode of transistor 218 and to the gate electrode of transistor 72 at input 75. The source electrode of transistor 224 is connected to drain electrode 28 of pass transistor 22 at node 98 and the source electrode of transistor 226 is connected to the source electrode of pass transistor 22. The source electrodes of transistors 224 and 226 may serve as the input terminals 236 and 234, respectively, of quiescent current regulation amplifier 212. A frequency compensation capacitor 221 is connected between input 75 and source of operating potential $V_{SS}$. It should be noted that the structure for providing frequency compensation is not limited to being a capacitor. For example, frequency compensation may be accomplished using a frequency compensation network 61 described with reference to FIG. 1 or other suitable frequency compensation structures.

Transistors 224 and 226 are configured such that the width to length $(W/L)_{224}$ ratio of transistor 224 is greater than the width to length ratio $(W/L)_{226}$ of transistor 226 and drain current $I_{224}$ is substantially equal to drain current $I_{226}$. By manufacturing transistors 224 and 226 to have different width to length ratios, $(W/L)_{224}$ and $(W/L)_{226}$, respectively, they have different gate to source voltages during voltage regulation. The difference in the gate to source voltages $V_{GS224}$ and $V_{GS226}$ of transistors 224 and 226, respectively, i.e., $(V_{GS226}-V_{GS224})$, is substantially equal to the offset voltage, $V_{OS}$, at inputs 236 and 234 of quiescent current regulation circuit 212. Offset voltage $V_{OS}$ is given by Equation 1 (EQT. 1) as follows:

$$V_{OS}=V_{GS226}-V_{GS224}=(2*(I_d/Kp)^{1/2}*(L_{226}/W_{226})^{1/2}-(L_{224}/W_{224})^{1/2} \quad \text{EQT. 1}$$

where:

$V_{GS226}$ is the gate to source voltage of transistor 226;

$V_{GS224}$ is the gate to source voltage of transistor 224;

$I_d$ is the drain current of transistors 224 and 226;

Kp is a process transconductance parameter for transistors 224 and 226;

$L_{226}/W_{226}$ is the reciprocal of the width to length ratio of transistor 226; and $L_{224}/W_{224}$ is the reciprocal of the width to length ratio of transistor 224.

It should be noted that transistor 224 sets a dc operational point of transistor 226 and that transistor 218 serves as an active load for sensing transistor 226.

Like low dropout voltage regulator 10, low dropout voltage regulator 210 includes two regulation loops: an output voltage regulation loop and a quiescent current regulation loop. In response to low dropout voltage regulator 210 operating under control of the output voltage regulation loop, the drain to source voltage ($V_{DS22}$) of pass transistor 22 is greater than or higher than offset voltage $V_{OS}$ and voltage $V_{CA}$ at the gate of transistor 72 is set to or tied to input voltage $V_{IN}$. The on-resistance of transistor 72 is sufficiently small that it does not influence the operation of the output voltage regulation loop. Error amplifier 12 generates a reference current $I_R$ in response to comparing voltage $V_{REF}$ that appears at input terminal 14 with voltage $V_{FB}$ that appears at input terminal 16. Current mirror 88 generates a current $I_{22}$ in response to its mirroring action on current $I_R$. In other words, current $I_R$ is amplified and mirrored to pass transistor 22 as drain to source current $I_{22}$.

As discussed above, when a load is coupled to node 98, a portion of current $I_{22}$ passes through the load and a portion flows through voltage divider network 90. When there is no load coupled to node 98, all or substantially all of current $I_{22}$ flows through voltage divider network 90. Error amplifier 12 operates to maintain feedback voltage $V_{FB}$ at substantially the same voltage level as voltage $V_{REF}$. Because resistors 92 and 94 are connected in series, the current generated by feedback voltage $V_{FB}$ and resistor 94 also flows through resistor 92. Thus, output voltage $V_{OUT}$ is the sum of voltage $V_{SS}$, the voltage across resistor 94, and the voltage across resistor 92, i.e., the sum of voltage $V_{FB}$ and the voltage across resistor 92. In response to feedback voltage $V_{FB}$ being lower than reference voltage $V_{REF}$, error amplifier 12 decreases a voltage $V_{G22}$ appearing at the gate of pass transistor 22 and increases current $I_R$, which increases current $I_{22}$ and increases output voltage $V_{OUT}$. In response to feedback voltage $V_{FB}$ being greater than reference voltage $V_{REF}$, error amplifier 12 increases voltage $V_{G22}$ appearing at the gate of pass transistor 22 and decreases current $I_R$, which decreases current $I_{22}$ and decreases output voltage $V_{OUT}$.

In response to low dropout voltage regulator 210 operating in a dropout regulation operating mode, i.e., when the quiescent current regulation loop operates under light load or no load conditions, quiescent current regulation amplifier 212 senses drain to source voltage $V_{DS22}$ of pass transistor 22 and regulates current $I_R$ using transistor 72. When the value of the drain to source voltage $V_{DS22}$ approaches the value of the offset voltage $V_{OS}$ during light load or no load conditions, quiescent current regulation amplifier 212 regulates current $I_R$ so that the drain to source voltage $V_{DS22}$ of pass transistor 22 becomes equal to offset voltage $V_{OS}$, reducing the quiescent current of low dropout voltage regulator 10 when a light load or no load is coupled to node 98. Typically a light load is one in which an output current has a value up to about 10% to 15% of the maximum load current for small currents, i.e., currents around 10 milliamps.

It should be appreciated that error output driver 15 may be implemented using other circuit configurations for current mirror 88, quiescent current regulation amplifiers 32 and 212, and current control circuit 72 without departing from the scope of the present invention.

By now it should be appreciated that a low dropout voltage regulator and a method for regulating an output voltage have been provided. In accordance with embodiments of the present invention, the quiescent current regulation amplifier (32 or 212) senses a drain to source voltage, $V_{DS}$, of pass transistor 22. In response to drain to source voltage $V_{DS}$ of pass transistor 22 being higher than offset voltage $V_{OS}$, the low dropout voltage regulator (10 or 210) is controlled by the output voltage regulation loop, wherein the voltage at the input of transistor 72 is set to input voltage $V_{IN}$. Thus, the quiescent current regulation amplifier (32 or 212) does not influence the output voltage regulation loop or the current consumption of the output buffer (15 or 15A).

In response to a light load, operation in the dropout voltage region, and the output voltage regulation loop controlling the low dropout voltage regulator (10 or 210), the output voltage regulation loop is unbalanced and the drain to source voltage $V_{DS}$ of pass transistor 22 tends towards a low value. In this case the quiescent current regulation amplifier (32 or 212) regulates through transistor 72 the drain to source voltage $V_{DS}$ of the pass transistor 22 to be the value of offset voltage $V_{OS}$. Thus, the dropout of the LDO is no smaller than offset voltage $V_{OS}$ and the current $I_R$ is given by the ratio of the current $I_{22}$ and the current mirror ratio N, which is determined by transistors 22 and 80.

It should be noted that the output voltage regulation loop includes a path including voltage $V_{FB}$, input 16 of error amplifier 12, the voltage at input 56 generated in response to comparing feedback voltage $V_{FB}$ with reference voltage $V_{REF}$, current control circuit 73, current mirror 88, output 98 and output 96, wherein feedback voltage $V_{FB}$ appears at output 96, which completes the loop. The quiescent current regulation loop includes a path including drain terminal 26 of transistor 22, output 98, quiescent current regulation amplifier 32, current control circuit 73 which generates a current $I_R$, current mirror 88, and the drain to source of transistor 22, wherein the drain of transistor 22 is connected to output 98 which completes the loop.

In addition, LDO voltage regulators in accordance with embodiments of the present invention occupy a reduced area.

Although specific embodiments have been disclosed herein, it is not intended that the invention be limited to the disclosed embodiments. Those skilled in the art will recognize that modifications and variations can be made without departing from the spirit of the invention. For example, field effect transistors 40, 42, 62, 64, 70, 72, 80, 216, 218, 220, 226, 224, and 22 can be replaced with bipolar transistors or the LDO voltage regulator may be implemented using combinations of bipolar and field effect transistors. It is intended that the invention encompass all such modifications and variations as fall within the scope of the appended claims.

What is claimed is:

1. A low dropout voltage regulator, comprising:

an error amplifier having a plurality of input terminals and an output terminal, a first input terminal of the plurality of input terminals of the error amplifier coupled for receiving a reference voltage; and an output driver having a plurality of input terminals and a plurality of outputs, a first input terminal of the plurality of input terminals of the output driver coupled to the output terminal of the error amplifier, a first output of the plurality of outputs of the output driver coupled to a second input terminal of the plurality of inputs of the error amplifier, a second input terminal of the plurality of input terminals of the output driver coupled for receiving an input signal, wherein the output driver comprises:

a first current mirror having a first input and first and second outputs;

a current control circuit having first and second inputs and first and second conduction terminals, the first input of the current control circuit serving as the first input of the output driver and the first conduction terminal coupled to the first output of the first current mirror; and a quiescent current regulation amplifier having first and second inputs and an output, the first input of the quiescent current regulation amplifier coupled to the first input of the first current mirror, the second input of the quiescent current regulation amplifier coupled to the second output of the first current mirror, and the output of the quiescent current regulation amplifier coupled to a second input of the current control circuit.

2. The low dropout voltage regulator of claim 1, wherein the error amplifier comprises:

a pair of transistors differentially configured, wherein a first transistor of the pair of transistors has a control electrode and first and second current carrying electrodes, wherein the control electrode of the first transistor serves as the first input terminal of the error amplifier and the second transistor of the pair of transistors has a control electrode and first and second current carrying electrodes, the control electrode of the second transistor serves as the second input terminal of the error amplifier; and a second current mirror having first and second terminals, the first terminal of the second current mirror coupled to the first current carrying electrode of the first transistor and the second terminal of the second current mirror coupled to the first current carrying electrode of the second transistor.

3. The low dropout voltage regulator of claim 2, wherein the error amplifier further comprises a frequency compensation network having first and second terminals, the first terminal of the frequency compensation network coupled to the first current carrying electrode of the second transistor and to the second terminal of the second current mirror.

4. The low dropout voltage regulator of claim 1, wherein the output driver further comprises a voltage divider network having first and second terminals and a node, the first terminal of the voltage divider network coupled to the second output of the first current mirror and the node coupled to the control electrode of a first transistor of a pair of transistors.

5. The low dropout voltage regulator of claim 4, wherein the first current mirror comprises:

a second transistor having a control electrode and first and second current carrying electrodes, the control electrode of the second transistor coupled to the first conduction terminal of the current control circuit to form the first output of the first current mirror; and a third transistor having a control electrode and first and second current carrying electrodes, the control electrode of the third transistor coupled to the control electrode of the second transistor, and the first current carrying electrode of the third transistor serving as the second output of the first current mirror.

6. The low dropout voltage regulator of claim 5, wherein the first current mirror further comprises:

a first resistor having first and second terminals, the first terminal coupled to the second current carrying electrode of the second transistor; and a second resistor having first and second terminals, the first terminal coupled to the control electrodes of the second and third transistors, and the second terminal coupled to the second terminal of the first resistor and to the second current carrying electrode of the third transistor, the second terminals of the first and second resistors and the second current carrying electrode of the third transistor configured to serve as the second input of the output driver.

7. The low dropout voltage regulator of claim 1, wherein the quiescent current regulation amplifier further comprises means for generating an offset voltage.

8. The low dropout voltage regulator of claim 1, wherein the quiescent regulation amplifier further comprises:

a second current mirror having first and second current conducting terminals, the first current conducting terminal coupled to the second input of the current control circuit; and a third current mirror having first, second, and third current conducting terminals, the first current conducting terminal of the third current mirror coupled to the first current conducting terminal of the second current mirror, the second current conducting terminal of the third current mirror coupled to the second current conducting terminal of the second current mirror, and the third current conducting terminal of the third current mirror coupled to the second input of the output driver.

9. The low dropout voltage regulator of claim 8, wherein the second current mirror comprises:

a fourth transistor having a control electrode and first and second current carrying electrodes, the first current carrying electrode of the fourth transistor serving as the first current conducting terminal of the third current mirror; and a fifth transistor having a control electrode and first and second current carrying electrodes, the first current carrying electrode of the fifth transistor serving as the second current conducting terminal of the third current mirror and the control electrode of the fifth transistor coupled to the control electrode of the fourth transistor.

10. The low dropout voltage regulator of claim 9, wherein the width to length ratios of the fourth and fifth transistors are configured such that the width to length ratio of the fourth transistor is greater than the width to length ratio of the fifth transistor, and a drain current of the fourth transistor is substantially equal to a drain current of the fifth transistor.

11. The low dropout voltage regulator of claim 1, wherein the current control circuit comprises:

a first transistor having a control terminal, a first current carrying terminal, and a second current carrying terminal, the control terminal of the first transistor serving as the input terminal of the output driver and the second current carrying terminal of the first transistor coupled to the first output of the first current mirror; and a second transistor having a control terminal, a first current carrying terminal, and a second current carrying terminal, the control terminal of the second transistor coupled to the output of the quiescent current regulation amplifier, the second current carrying terminal of the second transistor coupled to the first current carrying terminal of the first transistor, and the second current carrying terminal of the second transistor coupled for receiving a first source of operating potential.

12. The low dropout voltage regulator of claim 1, wherein the quiescent current regulation amplifier comprises:

an operational amplifier having an inverting input, a noninverting input, and an output, the noninverting input of the operational amplifier coupled to the input of the first current mirror and the output of the operational amplifier coupled to the control terminal of the second transistor, the operational amplifier including an input offset voltage.

13. A method for regulating a voltage, comprising:

operating a voltage regulator under control of an output voltage regulation loop in response to the voltage regulator not being in a low dropout region which includes generating a feedback voltage at a first output;

generating a first current in response to comparing the feedback voltage with a first reference voltage; and generating a second current in response to the first current, wherein a portion of the second current flows towards a second output; and operating the voltage regulator under control of a quiescent current regulation loop in response to the voltage regulator being in a low dropout region, wherein the voltage regulation loop and the quiescent current regulation loop operate at different times from each other.

14. The method of claim 13, wherein operating the voltage regulator under control of the output regulation loop in response to the voltage regulator not being in a low dropout region comprises:

setting a voltage at a first node to an input voltage level in response to a drain to source voltage of a transistor being greater than an offset voltage of a quiescent current regulation amplifier;

amplifying the first current; and wherein generating the second current in response to the first current includes mirroring the first current, wherein the second current flows from a current carrying terminal of a transistor.

15. The method of claim 13, further including increasing the second current in response to the feedback voltage being lower than the reference voltage and decreasing second current in response to the feedback voltage being greater than the reference voltage.

16. A method for regulating a voltage, comprising:

operating a voltage regulator under control of an output voltage regulation loop in response to the voltage regulator not being in a low dropout region; and operating the voltage regulator under control of a quiescent current regulation loop in response to the voltage regulator being in a low dropout region, which includes regulating a second current so that a drain to source voltage of a transistor substantially equals an offset voltage of a quiescent current regulation amplifier and reducing a first current in response to a light load or no load coupled to the voltage regulator, wherein the voltage regulation loop and the quiescent current regulation loop operate at different times from each other.

17. A method for regulating a voltage, comprising:

operating a voltage regulator under control of an output voltage regulation loop in response to the voltage regulator not being in a low dropout region which includes:

generating a feedback voltage at an output;

generating a first current in response to comparing the feedback voltage with a first reference voltage; and generating a second current in response to the first current, wherein a portion of the second current flows towards the output; and operating the voltage regulator under control of a quiescent current regulation loop in response to the voltage regulator being in a low dropout region, wherein the voltage regulation loop and the quiescent current regulation loop operate at different times from each other.

18. The method of claim 17, wherein operating the voltage regulator under control of a quiescent current regulation loop in response to the voltage regulator being in a low dropout region includes regulating the second current so that a drain to source voltage of a transistor substantially equals an offset voltage of a quiescent current regulation amplifier and reducing the first current in response to a light load or no load coupled to the voltage regulator.

19. A method for regulating a voltage, comprising:

in response to operating in a first mode:

comparing a feedback voltage with a reference voltage to generate a comparison signal;

generating a first current in response to the comparison signal;

mirroring the first current to generate a mirrored current that flows towards an output of a voltage regulator to adjust the output voltage of the voltage regulator and the feedback voltage; and in response to operating in a second mode, wherein the first mode and the second mode operate at different times from each other:

generating a first voltage at the output in response the mirrored current;

using a quiescent current regulation amplifier to generate a current adjust voltage in response to an input voltage and the first voltage appearing at first and second input terminals of the quiescent current amplifier;

generating the first current in response to the current adjust voltage; and mirroring the first current to form a mirrored current that serves as a drain to source current of a transistor coupled to the output of the voltage regulator.

20. The method of claim 19, further including using the mirrored current to set the drain to source voltage of the transistor substantially equal to an offset voltage associated with the quiescent current regulation amplifier.

* * * * *